US005762334A

United States Patent [19]

Kosi

[11] Patent Number: 5,762,334

[45] Date of Patent: Jun. 9, 1998

[54] REMINDER DEVICE AND METHOD TO LIMIT BETTING LOSES

[76] Inventor: James F. Kosi, 540 N. Lakeshore Dr. 711, Chicago, Ill. 60611

[21] Appl. No.: 820,611

[22] Filed: Mar. 19, 1997

[51] Int. Cl.[6] ..... G06C 3/00

[52] U.S. Cl. ..... 273/148 R; 463/16

[58] Field of Search ..... 273/148 R, 142 HA, 273/142 H; 463/16

[56] References Cited

U.S. PATENT DOCUMENTS

| | | | |
|---|---|---|---|
| 1,984,844 | 12/1934 | Slauson . | |
| 2,095,367 | 10/1937 | Mattson | 273/142 HA |
| 2,131,132 | 9/1938 | Alderman | 273/148 R |
| 2,702,954 | 3/1955 | Cline . | |
| 3,419,973 | 1/1969 | Manotas . | |
| 4,052,073 | 10/1977 | Miller | 273/148 R |
| 4,266,770 | 5/1981 | Yeager . | |
| 4,402,509 | 9/1983 | Dersher | 273/148 R |
| 4,712,796 | 12/1987 | Reiss . | |
| 4,721,309 | 1/1988 | Miesel . | |
| 5,482,275 | 1/1996 | Grinoch . | |
| 5,603,499 | 2/1997 | Jagosz | 273/148 R |
| 5,628,511 | 5/1997 | Jacoby | 273/148 R |

*Primary Examiner*—Raleigh W. Chiu
*Attorney, Agent, or Firm*—Don Moyer

[57] ABSTRACT

The reminder device records the number rolled in the game of craps and displays a reminder to bet only when the number rolled meets a predetermined criterion. The reminder device also records the number of times the dice have been rolled since the number rolled was equal to seven and displays a reminder to bet only when the number of rolls meets a predetermined criterion.

24 Claims, 1 Drawing Sheet

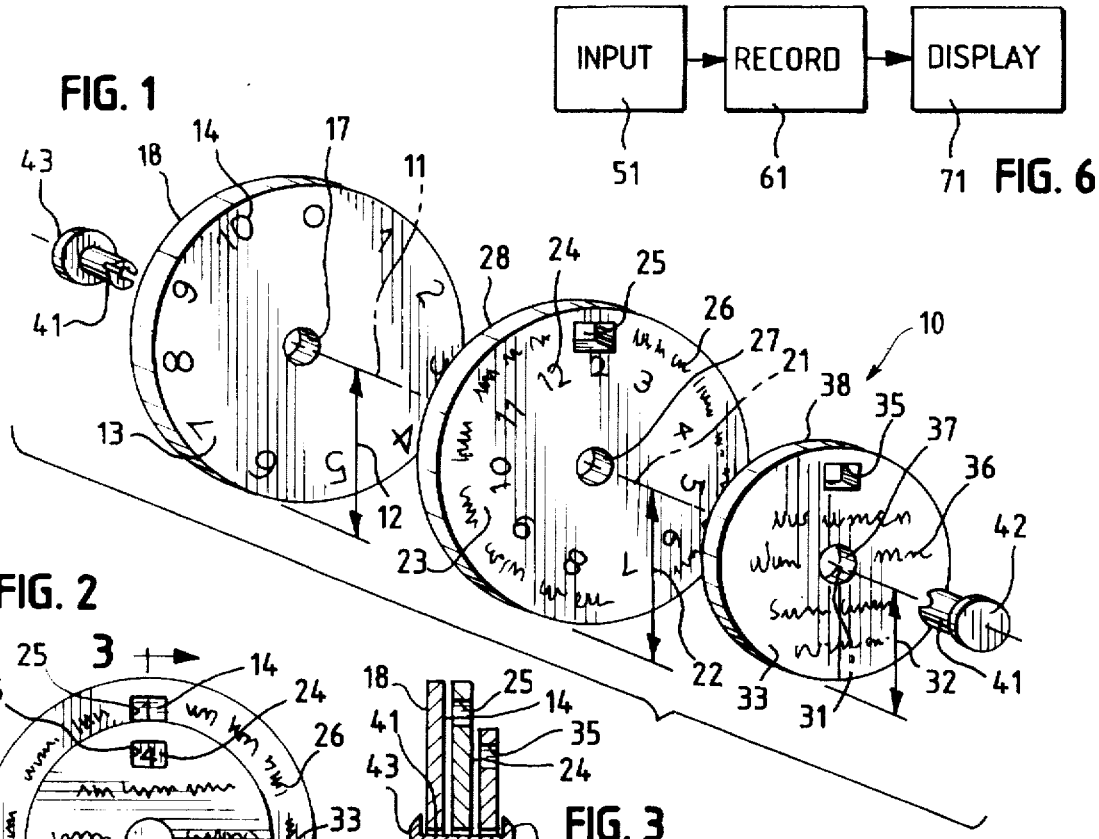
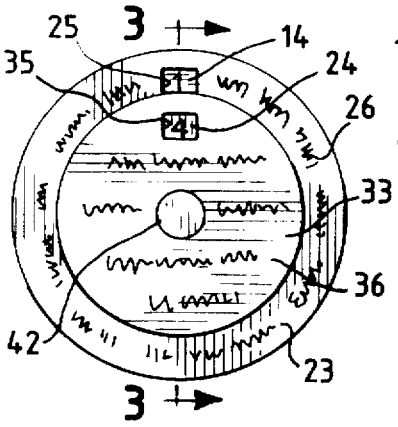
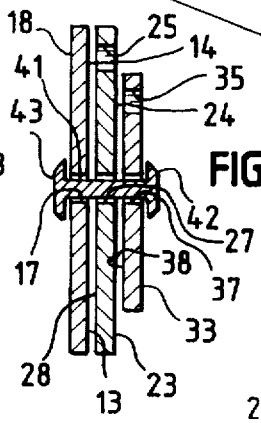
FIG. 3
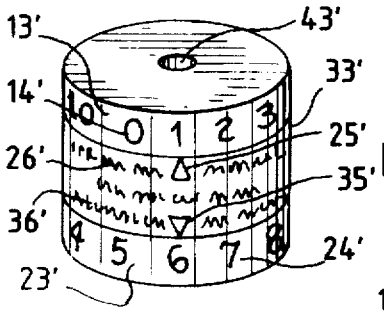
FIG. 4
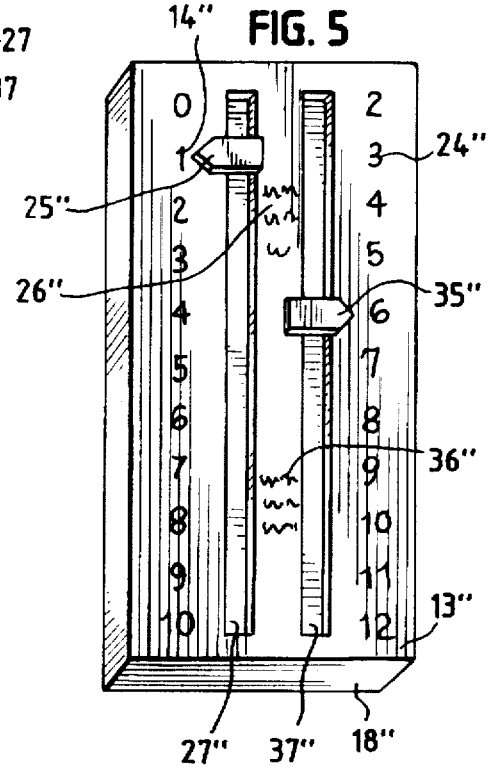
FIG. 5
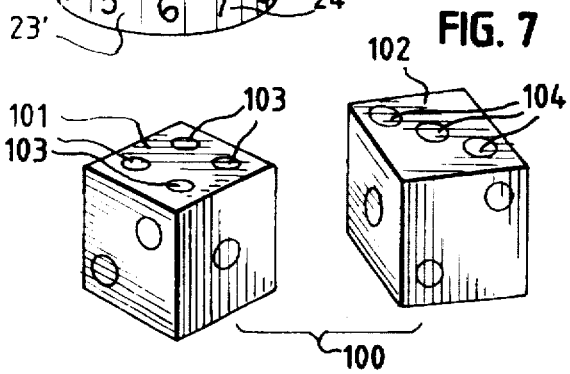
FIG. 7
FIG. 6

REMINDER DEVICE AND METHOD TO LIMIT BETTING LOSES

BACKGROUND

This invention records results of the roll of dice in the game of craps and displays a reminder which limits betting loses.

Recent increases in access to gaming establishments raise public policy concerns about increased betting loses. In the exciting and distracting atmosphere of gaming establishments it is hard for bettors to maintain the discipline needed to limit their betting loses. Thus a device and method which can limit betting loses would provide private and public benefits.

Gaming accessories are common. There are score indicating devices—such as that of Slauson shown in U.S. Pat. No. 1,984,844 and that of Cline shown in U.S. Pat. No. 2,702,954—and there are state of game indicating devices such as that of Grinoch shown in U.S. Pat. No. 5,482,275. These devices use the familiar mechanism wherein one element moves relative to one or more other elements to record information by showing the information through one or more windows. These devices are not useful in the game of craps nor to limit betting loses.

There are also devices which are intended to generate series of numbers for lottery betting such as that of Reiss shown in U.S. Pat. No. 4,712,796 and that of Miesel shown in U.S. Pat. No. 4,721,309. These devices are not useful for the game of craps and they do not limit betting loses. A device such as that of Yeager shown in U.S. Pat. No. 4,266,770 which is used to count cards in the game of blackjack, also known as twenty-one, can reduce betting loses because the odds of losing in blackjack change as cards are played from a standard deck. This method of betting is not useful in the game of craps.

Thus, there is an opportunity for a device and method which can be used for reducing betting loses in the game of craps.

SUMMARY

Objects of this invention comprise the following. Make a reminder device which can be used to practice a method for reducing betting loses in the game of craps. Make a device which has means for recording a roll sum, the roll sum being the sum of spots showing on the uppermost faces of dice after the dice have been rolled. Make a device which has means for recording a rolls count, the rolls count being the number of times the dice have been rolled since the roll sum was last equal to the number seven. Make a device which has means for displaying a reminder to refrain from betting unless the rolls count has reached a value which is stated in the rolls count reminder in order to limit betting loses. Make a device which has means for displaying a roll sum reminder to refrain from betting unless the roll sum is a value which is stated in the roll sum reminder in order to limit betting loses. Make a reminder device which uses discs which can rotate about a common axle relative to each other for the recording and displaying means. Make a reminder device which uses wheel rims which can rotate about a common axle relative to each other for the recording and displaying means. Make a reminder device which uses sliding pointers for the recording means. Make an electronic reminder device to practice the method for limiting betting loses.

In Summary, one embodiment of this invention has means for recording a rolls count, has means for displaying a rolls count reminder, has means for recording a roll sum, and has means for displaying a roll sum reminder.

Equivalent embodiments will be comprehended in the detailed description of the drawings, which will make additional equivalent embodiments obvious hereafter to people skilled in the art.

DRAWINGS

In the Drawings:

FIG. 1 is an exploded view which shows the new device in the form of discs rotatable about a common axis.

FIG. 2 shows a front view of the discs.

FIG. 3 is a view along line 3—3 in FIG. 2 which shows a side view of the discs.

FIG. 4 shows the new device in the form of wheels rotatable about a common axis.

FIG. 5 shows the new device in the form of a rectangular plate with slidable pointers.

FIG. 6 is a block diagram showing the new device in an electronic form.

FIG. 7 shows components of dice used in the game of craps

DETAILED DESCRIPTION

Components of the preferred form of the new reminder device 10 are shown in FIG. 1. There is a count disc having a count disc center 11, a count disc radius 12, a count disc front surface 13, and a count disc back surface 18. The integers zero through ten are provided 14 on the count disc front surface. These are rolls count numbers 14 which are defined more fully below. The count disc also has a count disc attachment hole 17 centered on the count disc center 11, and the count disc can rotate about an axle 41 which is headed 43 just beyond the count disc back surface 18 and which extends through the count disc attachment hole.

A marker disc has a marker disc center 21, a marker disc radius 22, a marker disc front surface 23, and a marker disc back surface 28. The marker disc has a marker disc attachment hole 27 centered on the marker disc center 21, and the marker disc can rotate about the axle 41 which also extends through the marker disc attachment hole. The marker disc has a marker disc window 25 extending through the marker disc from the marker disc front surface through the marker disc back surface. The marker disc window is located so that the rolls count numbers 14 on the count disc front surface 13 can show through the marker disc window 25 as the marker disc is rotated on the axle 41 relative to the count disc. The integers from two through twelve are provided 24 on the marker disc front surface. These are roll sum numbers 24 which are defined more fully below.

A sum disc has a disc center 31, a sum disc radius 32, a sum disc front surface 33, and a sum disc back surface 38. The sum disc has a sum disc attachment hole 37 centered on the sum disc center 31, and the sum disc can rotate about the axle 41 which also extends through the sum disc attachment hole and is headed 42 just beyond the sum disc front surface. The sum disc has a sum disc window 35 extending through the sum disc from the sum disc front surface through the sum disc back surface. The sum disc window is located so that the roll sum numbers 24 on the marker disc front surface 23 can show through the sum disc window 35 as the sum disc is rotated on the axle 41 relative to the marker disc.

The rolls count numbers on the count disc front surface and the roll sum numbers on the marker disc front surface can be defined by reference to FIG. 7. A roll sum number is shown in FIG. 7 which shows two dice 100, shows the uppermost faces 101 and 102 of the dice, and shows the spots 103 and 104 showing on the uppermost faces. The sum of these spots 103 plus 104 showing on the uppermost faces 101 and 102 after the dice have been rolled in the game of craps is a roll sum number. A rolls count number is the number times the dice have been rolled since the roll sum was last equal to the number seven.

In the game of craps bets are placed in anticipation of the roll sum which will be seen after the next roll of the dice. There are a number of specific types of bets which anticipate various roll sums and combinations of roll sums. For example, a bettor can bet that the next roll sum will be the number seven and can bet that the next roll sum will be the field, the field being any one of the numbers two, three, four, nine, ten, eleven, and twelve. The returns on these and the other specific types of bets are related to the probabilities of the occurrence of various values of a roll sum so that if a bettor makes the specific type of bet on each roll of the dice then the bettor must lose in the long run.

The new method for reducing betting losses in the game of craps comprises four steps. The first step is recording the rolls count. Thus, when the dice have been rolled, the count disc is rotated relative to the marker disc to increment the rolls count number 14 showing through the marker disc window 25 by one if the roll sum is not equal to the number seven, and alternatively, if the roll sum is equal to the number seven, then the count disc is rotated relative to the marker disc until the rolls count number equal to the number zero shows through the marker disc window 25.

The second step is displaying the rolls count reminder. The rolls count reminder is displayed 26 on the marker disc front surface. The preferred form of the rolls count reminder is: "Do not bet seven unless the rolls count shown in this window has reached ten." A user can substitute another number for the preferred "ten" by marking over the "ten" provided. The point of the rolls count reminder is to remind a bettor to refrain from making this specific type of bet on each roll of the dice.

The third step is recording the roll sum. This is done by rotating the sum disc relative to the marker disc until the one of the roll sum numbers 24 equal to the roll sum showing on the rolled dice shows through the sum disc window 35.

The fourth step is displaying the roll sum reminder. The roll sum reminder is displayed 36 on the sum disc front surface. The preferred form for the roll sum reminder is: "Do not bet the field unless the current roll sum is five or six or eight and the previous roll sum shown in this window is five or six or eight." The point of the roll sum reminder is to remind a bettor to refrain from making a specific type of bet—betting the field in this case—on every roll of the dice. Other forms of the roll sum reminder which remind a bettor to refrain from making another specific type of bet on each roll of the dice would be equivalent.

Another equivalent form of the new reminder device is shown in FIG. 4. Here a count wheel has an rim 13' with the rolls count numbers provided 14' on the count wheel rim 13'. A sum wheel has a sum wheel rim 23' with the roll sum numbers provided 24' on the sum wheel rim 23'. A marker wheel located between the count wheel and the sum wheel has a marker wheel rim 33'. Provided on the marker wheel rim 33' are a count pointer 25' pointing toward the rolls count numbers on the count wheel rim 13', a sum pointer 35' pointing toward the roll sum numbers on the sum wheel rim 23', the rolls count reminder 26', and the roll sum reminder 36'. There is an axle which is headed just beyond the count wheel 43', headed just beyond the sum wheel, and extending through attachment holes at the centers of the count wheel, the marker wheel, and the sum wheel. The count wheel can be rotated relative to the marker wheel until the count pointer 25' points to the one of the rolls count numbers equal to the rolls count. The sum wheel can be rotated relative to the marker wheel until the sum pointer 35' points to the one of the roll sum numbers equal to the roll sum.

A third equivalent form of the new reminder device is shown in FIG. 5. Here a rectangular plate has a front surface 13", a back surface 18", a count slot 27", and a sum slot 37". The rolls count numbers are provided 14" on the plate front surface adjacent to the count slot, and the roll sum numbers are provided 24" on the front surface adjacent to the sum slot. A sliding count pointer 25" is movably attached in the count slot and can move along the count slot to point to the one of the rolls count numbers equal to the rolls count. Also, a sliding sum pointer 35" which is movably attached in the sum slot can move along the sum slot to point to the one of the roll sum numbers equal to the roll sum. The rolls count reminder 26" and the roll sum reminder 36" are provided on the plate front surface.

Each of these forms of the invention—FIG. 1, FIG. 4, and FIG. 5—can be used to practice the new method for limiting betting loses. The first step is recording the rolls count by rotating the count disc shown in FIG. 1, rotating the count wheel shown in FIG. 4, and moving the sliding count pointer shown in FIG. 5 until the rolls count is recorded by showing through the marker disc window 25, by being pointed to pointed to by the count pointer 25', and by being pointed to by the sliding count pointer 25". The second step is displaying the rolls count reminder which is provided 26 on the marker disc front surface, provided 26' on the marker wheel rim, and provided 26" on the plate front surface.

The third step is recording the roll sum by rotating the sum disc shown in FIG. 1, by rotating the sum wheel shown in FIG. 4, and by moving the sliding sum pointer shown in FIG. 5 until the roll sum is recorded by showing in the sum disc window 35, by being pointed to by the sum pointer 35', and by being pointed to by the sliding sum pointer 35". The fourth step is displaying the roll sum reminder which is provided 36 on the sum disc front surface, provided 36' on the sum wheel rim, and provided 36" on the plate front surface.

The method of the invention can also be practiced using electronic components as shown in FIG. 6. Electronic components which are means for recording and displaying comprise an input component 51, a memory component 61, and a displaying component 71. The input component 51 can be a keypad and can be any equivalent input component. The input component is count inputting means for producing a count signal representing the rolls count, and is sum inputting means for producing a sum signal representing the roll sum.

The memory component 61 can be a magnetic memory component and can be any equivalent memory component. The memory component is count memory means for receiving the count input signal and recording a count signal representing the count input signal, and is sum memory means for receiving the sum input signal and recording a sum signal representing the sum input signal.

The displaying component 71 can be a liquid crystal display, can be a light emitting diode display, and can be any equivalent display component. The displaying component is count displaying means for being actuated by the count memory signal and displaying the rolls count reminder, and is sum displaying means for being actuated by the sum memory signal and displaying the sum reminder.

Since the rolls count on a given roll is the rolls count from the previous roll incremented by one if the roll sum is not seven and the rolls count is zero if the roll sum is seven, the first step can be accomplished by means for calculating which is built into the recording components 51 and 61.

The first and second steps of the method can be practiced alone without the third and fourth steps. Correspondingly, in each of the forms of the invention the elements used to practice the third and fourth steps of the method can be left off. In the form shown in FIG. 1 this entails leaving off the sum disc and leaving off the roll sum numbers provided on the marker disc. In the form shown in FIG. 4 this entails leaving off the sum wheel, leaving off the sum pointer, and leaving off the roll sum reminder. In the form shown in FIG. 5 this entails leaving off the sum sliding pointer, leaving off the roll sum numbers, and leaving off the roll sum reminder. In form shown in FIG. 6 this entails imputing only the rolls count and displaying only the rolls count reminder.

Other betting reminders—such as amounts of bets to be made—can be provided on the count, marker, and sum discs; on the count, marker, and sum wheels; and on the plate. Also the surfaces can be designed so that reminders can be added by a person using the invention. The electronic form of the reminder device can be designed to display various kinds of information related to amounts of bets, probabilities of outcomes, and the like.

Other equivalent forms for the recording means, the displaying means, and the reminders shown in the figures and described above will be obvious hereafter to people skilled in the art. Similarly, other equivalent means for practicing the method of the invention will be obvious hereafter to people skilled in the art. It is understood therefore that this invention is not limited to the particular examples illustrated here.

I claim:

1. In combination with two dice for the game of craps, the two dice displaying a roll sum, wherein bets are placed in anticipation of a roll sum, the roll sum being a sum of spots showing on uppermost faces of the two dice after the two dice have been rolled, a reminder device comprising:

means for recording a rolls count, the rolls count being a rolls count number equal to the number of times the dice have been rolled since the roll sum was equal to the number seven; and means for displaying a rolls count reminder.

2. The reminder device of claim 1 further comprising:

means for recording the roll sum; and means for displaying a roll sum reminder.

3. The reminder device of claim 2 wherein the means for recording the rolls count comprises:

a count disc, the count disc being generally circular, the count disc having a count disc center, the count disc having a count disc front surface, the count disc having rolls count numbers provided on the front surface; and a marker disc, the marker disc being generally circular, the marker disc having a marker disc center, the marker disc having a marker disc front surface, and the marker disc having a marker disc window through the marker disc, the marker disc being rotatably attached to the count disc so that count disc can be rotated about the marker disc center until one of the rolls count numbers provided on the count disc front surface which is equal to the rolls count shows through the marker disc window.

4. The reminder device of claim 3 wherein the means for recording a roll sum comprises:

roll sum numbers provided on the marker disc front surface; and a sum disc, the sum disc being generally circular, the sum disc having a sum disc center, the sum disc having a sum disc front surface, the sum disc having a sum disc window through the sum disc, the sum disc being rotatably attached to the marker disc so that the sum disc can be rotated about the marker disc until one of the roll sum numbers which is equal to the roll sum shows through the sum disc window.

5. The reminder device of claim 4 wherein the means for displaying the rolls count reminder comprises roll count markings on the marker disc front surface.

6. The reminder device of claim 4 wherein the means for displaying the roll sum reminder comprises roll sum markings on the sum disc front surface.

7. The reminder device of claim 2 wherein the means for recording the rolls count comprises:

a count wheel, the count wheel being generally circular, the count wheel having a count wheel rim, the count wheel having rolls count numbers provided on the count wheel rim; and a marker wheel, the marker wheel being generally circular, the marker wheel having a marker wheel rim, the marker wheel rim having a count pointer provided on the marker wheel rim, the marker wheel being rotatably attached to the count wheel so that the count wheel can be rotated relative to the marker wheel until one of the rolls count numbers equal to the rolls count is pointed to by the count pointer.

8. The reminder device of claim 7 wherein the means for recording a roll sum comprises:

a sum pointer provided on the marker wheel rim; and a sum wheel, the sum wheel being generally circular, the sum wheel having a sum wheel rim, the sum wheel rim having roll sum numbers provided on the sum wheel rim, the sum wheel being rotatably attached to the marker wheel so that the sum wheel can be rotated relative to the marker wheel until one of the roll sum numbers equal to the roll sum is pointed to by the sum pointer.

9. The reminder device of claim 8 wherein the means for displaying the rolls count reminder comprises rolls count markings provided on the marker wheel rim.

10. The reminder device of claim 8 wherein the means for displaying the roll sum reminder comprises roll sum markings provided on the marker wheel rim.

11. The reminder device of claim 2 wherein the means for recording the rolls count comprises:

a plate, the plate having a count slot in the plate, the plate having rolls count numbers provided on the plate adjacent to the count slot; and a sliding count pointer movably attached in the count slot so that the sliding count pointer can be moved along the count slot to point to one of the rolls count numbers equal to the rolls count.

12. The reminder device of claim 11 wherein the means for recording a roll sum comprises:

a sum slot in the plate wheel with roll sum numbers provided on the plate adjacent to the sum slot; and a sliding sum pointer movably attached in the sum slot so that the sliding sum pointer can be moved along the sum slot to point to one of the roll sum numbers equal to the roll sum.

13. The reminder device of claim 12 wherein the means for displaying the rolls count reminder comprises rolls count markings provided on the plate.

14. The reminder device of claim 12 wherein the means for displaying the roll sum reminder comprises roll sum markings provided on the plate.

15. The reminder device of claim 2 wherein the means for recording the rolls sum, and displaying the roll sum reminder are electronic components comprising:

sum inputting means for producing a sum input signal representing the roll sum;

sum memory means for receiving the sum input signal and recording a sum memory signal representing the sum input signal; and sum displaying means for displaying the roll sum reminder, the sum displaying means being actuated by the sum memory signal.

16. The reminder device of claim 1 wherein the means for recording the rolls count comprises:

a count disc, the count disc being generally circular, the count disc having a count disc center, the count disc having a count disc front surface, the count disc having rolls count numbers provided on the front surface; and a marker disc, the marker disc being generally circular, the marker disc having a marker disc center, the marker disc having a marker disc front surface, and the marker disc having a marker disc window through the marker disc, the marker disc being rotatably attached to the count disc so that count disc can be rotated about the marker disc center until one of the rolls count numbers provided on the count disc front surface which is equal to the rolls count shows through the marker disc window.

17. The reminder device of claim 3 wherein the means for displaying the rolls count reminder comprises rolls count markings on the marker disc front surface.

18. The reminder device of claim 1 wherein the means for recording the rolls count comprises:

a count wheel, the count wheel being generally circular, the count wheel having a count wheel rim, the count wheel having rolls count numbers provided on the count wheel rim; and a marker wheel, the marker wheel being generally circular, the marker wheel having a marker wheel rim, the marker wheel rim having a count pointer provided on the marker wheel rim, the marker wheel being rotatably attached to the count wheel so that the count wheel can be rotated relative to the marker wheel until one of the rolls count numbers equal to the rolls count is pointed to by the count pointer.

19. The reminder device of claim 18 wherein the means for displaying the rolls count reminder comprises rolls count markings provided on the count wheel rim.

20. The reminder device of claim 1 wherein the means for recording the rolls count comprises:

a plate, the plate having a count slot in the plate, the plate having rolls count numbers provided adjacent to the count slot; and a sliding count pointer movably attached in the count slot so that the sliding count pointer can be moved along the slot to point to one of the rolls count numbers equal to the rolls count.

21. The reminder device of claim 20 wherein the means for displaying the rolls count reminder comprises rolls count markings provided on the plate.

22. The reminder device of claim 1 wherein the means for recording the rolls count and the means for displaying the rolls count reminder are electronic components comprising:

count inputting means for producing a count input signal representing the rolls count;

count memory means for receiving the count input signal and recording a count memory signal representing the count input signal; and count displaying means for displaying the rolls count reminder, the count displaying means being actuated by the count memory signal.

23. In combination with two dice for the game of craps, the two dice displaying a roll sum, wherein bets are placed in anticipation of a roll sum, the roll sum being a sum of spots showing on uppermost faces of the two dice after the two dice have been rolled, a reminder method comprising the steps of:

providing a reminder device for recording a rolls count and for displaying a rolls count reminder, the rolls count being a rolls count number equal to the number of times the dice have been rolled since the roll sum was equal to the number seven;

recording the rolls count; and displaying the rolls count reminder.

24. The method of claim 23 further comprising the steps of:

providing means for recording the roll sum and means for displaying a roll sum reminder the roll sum recording means and the roll sum reminder display means being integral parts of the reminder device;

recording the roll sum; and displaying the roll sum reminder.

* * * * *